United States Patent [19]

Yajima

[11] Patent Number: 4,676,217

[45] Date of Patent: Jun. 30, 1987

[54] INTERNAL COMBUSTION ENGINE HAVING A SUPERCHARGER

[75] Inventor: Tsunao Yajima, Hiroshima, Japan

[73] Assignee: Mazda Motor Corporation, Hiroshima, Japan

[21] Appl. No.: 829,917

[22] Filed: Feb. 18, 1986

[30] Foreign Application Priority Data

Feb. 19, 1985 [JP] Japan ..... 60-22252[U]

[51] Int. Cl.[4] ..... F02B 33/00

[52] U.S. Cl. ..... 123/559; 123/564

[58] Field of Search ..... 123/559, 564; 60/39.45; 417/64

[56] References Cited

FOREIGN PATENT DOCUMENTS 72059 2/1983 European Pat. Off. ..... 123/559 A
123990 11/1984 European Pat. Off. .
127839 9/1980 Japan .
13921 1/1985 Japan .

*Primary Examiner*—Stephen F. Husar
*Attorney, Agent, or Firm*—Fleit, Jacobson, Cohn & Price

[57] ABSTRACT

An internal combustion engine having supercharger including an exhaust manifold integrated with an exhaust chamber for weakening a pulsation of exhaust gas, and a bypassing passage connected to the exhaust chamber for bypasing the supercharger. The exhaust manifold and the exhaust chamber can be manufactured integrally with each other by casting employing only a cope, a drag and a core supported effectively.

15 Claims, 5 Drawing Figures

INTERNAL COMBUSTION ENGINE HAVING A SUPERCHARGER

FIELD OF THE INVENTION

The present invention relates to an internal combustion engine having a supercharger, in particular to an engine provided with an exhaust gas chamber disposed upstream the supercharger in order to weaken pulsations of exhaust gas.

DESCRIPTION OF PRIOR ART

Hithertofore, two types of supercharging systems have been known for internal combustion engines of motor vehicles. One of them is of a type which is known a mechanical supercharger in which the engine output is used to supercharge the intake gas. The other is of a type which utilizes an exhaust gas energy, such as turbo-supercharger. In the Japanese utility model public disclosure No. 55-127839, there is disclosed another type of supercharger utilizing the exhaust gas energy. The proposed supercharger comprises a rotor formed with a plurality of axially extending gas passages which are separated from each other in the circumferential direction, and a cylindrical casing for receiving the rotor therein and supporting the rotor for rotation about the axis thereof. The casing is provided with end plates for the exhaust gas and the intake gas located at the opposite ends of the rotor in which exhaust gas inlet and outlet gas openings and intake gas inlet and outlet gas openings respectively. The arrangement are such that the inlet gas is drawn into the gas passages through the intake gas inlet opening and brought into contact with the exhaust gas introduced into the gas passages through the exhaust gas inlet opening to be compressed by the pressure of the exhaust gas.

In such type of supercharger as adapted to utilizes the exhaust gas energy, it is desirable to connect the exhaust passage with the supercharger in a manner that a pulsation of the exhaust gas is not transmitted into the supercharger. For this purpose, it is known to provide an exhaust chamber of a certain capacity integrated with a exhaust manifold upstream of the supercharger or downstream of the exhaust manifold to thereby weaken the pulsation of the exhaust gas. Further, there is proposed an arrangement that a supercharger is disposed over an exhaust chamber in a manner that the exhaust gas from the exhaust chamber is introduced upwardly into the supercharger. Moreover, it is known that an engine is provided with a bypassing passage in an exhaust passage for bypassing a supercharger, and a waste gate valve disposed in the bypassing passage wherein the valve is adapted to be actuated in accordance with an engine operating condition in order to control the amount of the exhaust gas for the supercharger to thereby control the supercharged pressure of intake gas.

The European patent application No. 84104221.1 laid-open to the public inspection on Nov. 7, 1984, discloses an internal combustion engine provided with a supercharger utilizing the exhaust gas pressure and an exhaust bypassing mechanism as mentioned above wherein the supercharger is provided an opening in the casing thereof for communicating with the bypassing passage therethrough.

The Japanese Public Disclosure No. 60-13921 discloses a similar type of engine as disclosed in the European patent application.

In the arrangement as proposed in the European patent application No. 8410421.1, it is however disadvantageous in that an exhaust bypassing passage for a waste gate valve is connected to the exhaust side of the supercharger casing to reduce the area of the exhaust passage in the casing resulting in an increase of the back pressure to the engine. Therefore, it is undesirable to provide the opening for connecting the bypass in the exhaust side of the casing.

In casting process of an integrated exhuast manifold and exhaust chamber, it is desirable to reduce the number of molds employed in the process as small as possible, preferably to employ only main molds splitted to a cope and a drag, and a core in order to facilitate the casting process. Where the main molds and the core is employed for casting the exhaust manifold integrated with the exhaust chamber, it is necessary to prepare a support for the core in order to obtain a sufficient capacity of the exhaust chamber.

In such arrangement that the supercharger is located on the exhaust chamber, it is however impossible to support the core properly since the opening for the supercharger is formed on the top portion thereof so that the capacity of the exhaust chamber cannot be obtained enough to weaken the pulsation of the exhaust gas. Therefore, it is necessary to increase the number of the mold in order to support the core properly through the opening of the exhaust chamber for the supercharger. Further, in the arrangement, the exhaust gas is introduced downwardly into the exhaust chamber against the bottom plate thereof to be inverted upwardly, in turn introduced into the supercharger. As a result, there is a problem that undesirable substances in the exhaust gas, such as carbon particles, iron oxide, oil and the like, are deposited in the exhaust chamber.

Further, in the arrangement, where the exhaust chamber is of a sufficient capacity, bolts are extended through the exhaust chamber for fixing the supercharger thereto in order to facilitate assembling work. However, there occurs a problem that the bolts thermally elongate in the direct contact with the exhaust gas to loosen unduly.

OBJECT OF THE INVENTION

It is therefore an object of the present invention to provide an internal combustion engine with a supercharger comprising an exhaust chamber of a sufficient capacity to damp the pulsation of the exhaust gas effectively.

Another object of the present invention is to provide an engine comprising an exhaust manifold integrated with the exhaust chamber manufactured by employing only a cope, a drag and a core supported properly.

A further object of the present invention is to provide a rigid connection between the exhaust chamber and the supercharger not subjected to a thermal influence from the exhaust gas.

SUMMARY OF THE INVENTION

According to the present invention, the above and other object can be accomplished by an engine having a supercharger comprising an exhaust manifold fixed to a side surface of a cylinder head and extending downwardly, an enlarged exhaust chamber of a certain capacity connected to the downstream end of the exhaust manifold, an opening formed on the exhaust chamber, a supercharger fixed to an upper portion of the exhaust chamber, and a bypassing pipe connected to the opening of the exhaust chamber so that the exhaust chamber can be communicated with an exhaust passage downstream of the supercharger bypassing the supercharger.

With this arrangement of the present invention, the exhaust manifold integrated with the exhaust chamber can be manufactured by casting in employing a cope, a drag with only one split line, and a core wherein the core is supported rigidly through openings of the manifold for being connected to the cylinder head at one end, and through the opening of the exhaust chamber at the other end. Accordingly, it becomes possible to provide the exhaust chamber with a sufficient capacity to weaken the pulsation of the exhaust gas effectively. It is preferable that the opening for the bypassing passage is formed at the substantially same level as an opening for fixing the supercharger to the exhaust chamber therethrough. Therefore, it can be restrained that undesirable substances in the exhaust gas are deposited on the inner surface of the exhaust chamber.

According to the present invention, the supercharger is preferably connected to the exhaust chamber at an offset position from the main body thereof so that the supercharger can be ridigly fixed to the exhaust chamber by bolts wherein the bolts can be applied through the outside of the exhaust chamber. Consequently, a thermal extension of the bolts is restrained effectively to maintain a rigid connection between the exhaust chamber and the supercharger.

The above and other objects and features of the present invention will become apparent from the following description of preferred embodiments taking into reference to the accompanying drawings.

DESCRIPTION OF THE PREFERRED EMBODIMENTS

Figure 1:
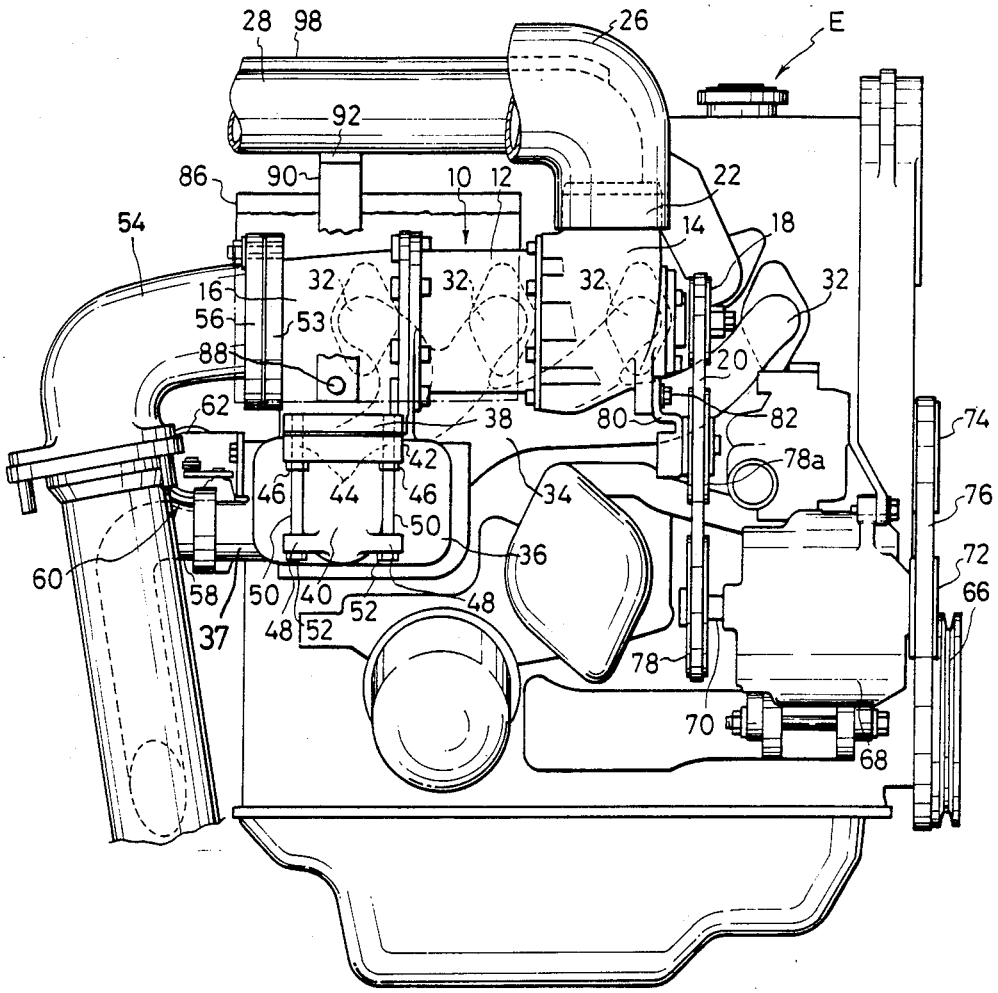
FIG. 1 is a front view of an internal combustion engine with a supercharger in accordance with a preferred embodiment of the present invention.

Referring to the FIG. 1, an illustrated engine E is provided four cylinders traversely disposed and a supercharger 10 positioned rearward of the cylinders. The supercharger 10 is proivded with a cylindrical rotor casing 12 extending traversely in FIG. 1, an intake casing 14 mounted to the rotor casing 12 at one end thereof, and an exhaust casing 16 mounted to the rotor casing 12 at the other end. In the rotor casing 12, a rotor (not shown) is disposed rotatably. A rotation shaft of the rotor extending in the longitudinal direction of the rotor casing 12 is provided with a plurality of walls splitting the inner space of the rotor casing 12 circumferentially to define a plurality of gas passages axially extending. The rotor shaft extends through the intake casing 14 and is connected to a drive pulley 18 at one end. The pulley 18 is adapted to be driven through a belt 20. The rotor casing 12 is provided with an inlet and outlet for an intake gas at one end plate of a side of the intake casing 14. The rotor casing 12 is also provided with the other end plate formed on an inlet and an outlet for an exhaust gas which is disposed opposite side of the rotor.

Figure 2:
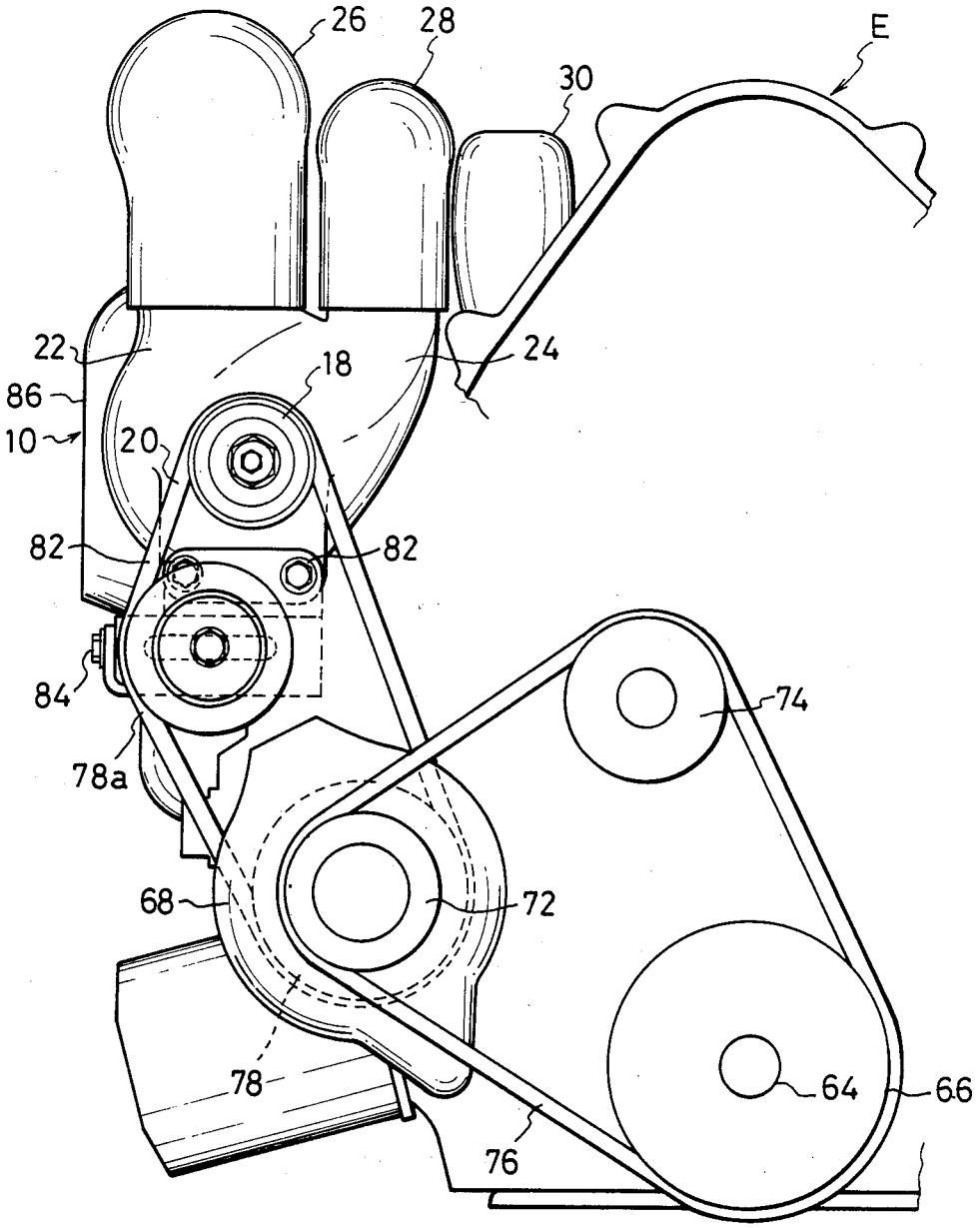
FIG. 2 is a side view of the engine shown in FIG. 1.
Figure 3:
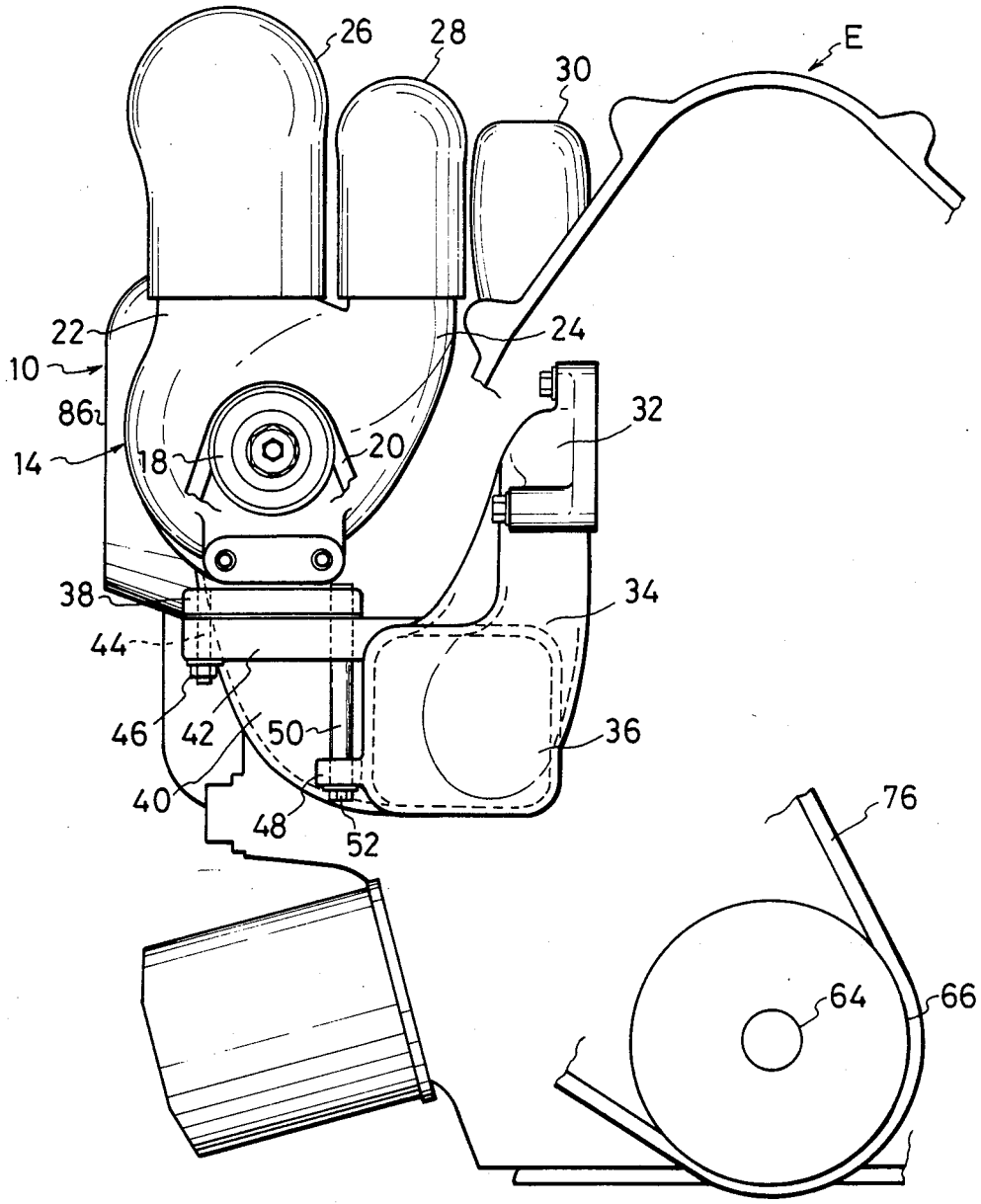
FIG. 3 is a side view showing a connection of a supercharger and an exhaust chamber of the engine.

As shown in FIG. 2, the intake casing 14 is formed on an intake passage 22 for introducing the intake gas into the inlet of the end plate, and an intake passage 24 for a supercharged gas from the outlet of the end plate. The intake passage 22 is connected to an funnel 26 of plastic and the intake passage 24 is connected to a funnel 28. The funnel 26, 28 extend upwardly from the connected ends thereof, in turn are curved to extend over and parallel to the supercharger. The funnel 26 is connected to an air filter (not shown) in the upstream thereof and the funnel 28 is connected to an intake manifold 30 at the downstream thereof. The exhaust casing 16 is provided with an exhaust inlet passage for introducing the exhaust gas into the gas passages of the rotor through the inlet of the end plate of the rotor casing and an exhaust outlet passage for exhausting the exhaust gas through the outlet of the end plate of the rotor casing. Wherein the exhaust inlet passage is oriented downwardly to be communicated with the outlet of the supercharger while the exhaust outlet passage is oriented traversely. An exhaust system of the engine E is provided with one piece exhaust structure A comprising exhaust pipes 32 connected to the cylinders respectively, an exhaust manifold 34 integrated with the pipes 32, an exhaust chamber 36 integrated with the manifold 34 for weakening the pulsation of the exhaust gas.

At the lower end of the exhaust inlet, the exhaust casing 16 is provided with a flange 38 connected with a flange 42 mounted on the upper end of an outlet pipe portion 40 extending upwardly. In this arrangement, the monoblock exhaust structure A is fixed to the flange 38 through the flange 42 by means of bolts at the four points. In the rear side, nuts 46 are applied to a pair of stud bolts 44 mounted on the flange 38 through the flange 42 respectively to fix the flange 38, 42. In the front side, nuts 52 are applied to a pair of bolts 50 extending through holes of the flange 38, 42 and holes of extensions 48 formed on the lower portion in the external wall of the exhaust chamber 36. A flange 56 of an exhaust pipe 54 is connected to a flange 53 formed on the end of the outlet passage of the exhaust casing 16 so that the outlet passage is communicated with the exhaust passage of the exhaust pipe 54. The exhaust chamber 36 is provided with a waste gate port 37 laterally opened, to which a bypassing passage 58 is connected at one end for bypassing the supercharger 10. At the other end, the bypassing passage 58 is connected to the exhaust pipe 54.

Figure 4:
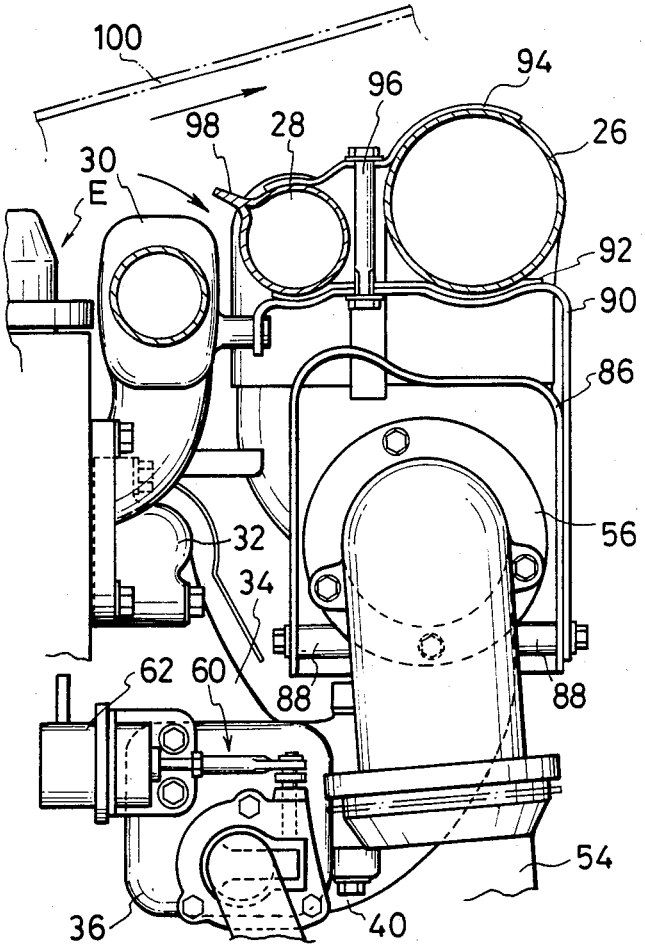
FIG. 4 is a side view opposite to the FIG. 2 of the engine.

Referring to FIG. 4, there is disposed a waste gate valve 60 in the bypassing passage 58 for controlling the flow area thereof. The waste gate valve 60 is provided with an actuator 62 to be driven thereby. As shown in FIG. 1 and FIG. 2, the engine E is provided with a pulley 66 fixed to a crank shaft 64 at one side. A belt 76 is mounted on the pulley 66 through a pulley 72 fixed to the one end of a drive shaft 70 for a alternator 68 and through an idler pulley 74 fixed to the engine E so that output of the crank shaft is transmitted to the drive shaft 70 through the belt 76. To the other end of the drive shaft 70, there is fixed a pulley 78 so that the output of the crank shaft 64 is also transmitted to the pulley 78 through the drive shaft 70. In turn, the output of the crank shaft 64 is transmitted to the pulley 18 fixed to the rotor shaft to thereby rotate the rotor. In this arrangement, the belt 20 is mounted through the idler pulley **78*a* disposed between the pulley 18 and pulley 78 so that a desirable tension is obtained for the belts 20. The idler 78***a* is fixed to the intake casing 14 through a bracket 80 and a bolt 82 to be positioned within the same plain as the pulley 18 is positioned.

The idler can be moved in the traverse direction in FIG. 2 by means of a bolt 84 so that a tension of the belt 20 can be controlled. As shown in FIG. 4, a cover plate 86 is mounted on the supercharger 10 by means of a bolt 88 thereover so that the supercharger 10 is isolated from the funnel 26 and 28. The funnel 26, 28 and the cover-plate 86 are supported by a bracket 90 at the lower side thereof through a heat insulating sheet 92 by means of the bolt 88. The funnel 26 and 28 are supported by a member 94 provided opposite to the bracket 90 at the upper side through bolt 96 for fixing the funnel 26, 28 to the bracket 90. In FIG. 4, the funnel 28 is formed with a projection 98 projecting upwardly and forwardly and extending in the longitudinal direction of the funnel 28. The projection 98 interrupts a stream of a cooling air flowing rearward in a lower space of a bonnet 100 to deflect a part of the air downwardly so that a part of the air flows between the engine E and the funnel 28 to cool the exhaust system.

In the arrangement as mentioned above, the supercharger 10 is supported by the monoblock structure A only at the lower side thereof so that this arrangement allows the supercharger 10 to expand and shrink thermally without a serious restriction.

Figure 5:
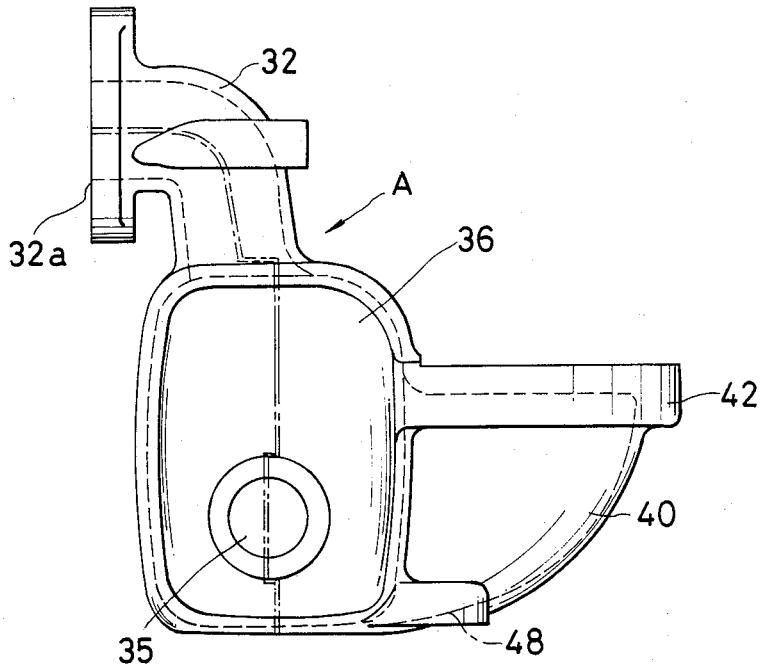
FIG. 5 is a view showing a mono block exhaust structure in accordance with the present invention.

In the arrangement, the intake gas is introduced into the intake casing 14 through the intake funnel 26, then into the gas passages of the rotor through the inlet in the end plate of the rotor casing 12. The intake gas is brought into contact with the exhaust gas under pressure in the gas passage to be compressed and conducted to the intake passage of the intake casing 14 through the outlet of the end plate. The compressed or supercharged intake gas is introduced into the intake manifold 30 through the intake funnel 28, and into the cylinders through separated intake pipes respectively. On the other hand, the exhaust is introduced into the exhaust manifold 34 through the exhaust pipes 32, then into the exhaust chamber 36 so that the pulsation of the exhaust gas is weakend. In turn, the exhaust gas flows upwardly to be introduced into the inlet passage of the exhaust casing 16 through the outlet pipe 40 of the exhaust chamber 36, then into the gas passages of the rotor through the inlet of the end plate opposite to the intake gas. The exhaust gas is brought into contact with the intake gas in the gas passages to provide a supercharged pressure with the intake gas. When the rotor rotates to cause the gas passages to be aligned with the outlet of the end plate provided at the exhaust side of the rotor casing, the exhaust gas is exhausted from the gas passages to the exhaust pipe 54 through the outlet and the exhaust passage of the exhaust casing 16. When the waste gate valve 60 disposed in the bypassing passage 58 is fully opened, the exhaust gas is directly introduced into the exhaust pipe 54 through the bypassing passage bypassing the supercharger 10. In the illustrated embodiment, the rotor is driven by the output of the crank shaft 64 to have a predetermined rotation rate corresponding the engine speed. Now referring to FIG. 5, the structure A is manufactured by casting as a monoblock structure employing a cope, a drag and a core. In the FIG. 5, a pair of phantom lines designate a split line of the molds. The core is adapted to be supported rigidly through openings 32*a* of the exhaust pipes 32 for communicating with exhaust passages in the cylinder head at one end and through an opening 35 for the bypassing passage 58 at the other end.

It is further understood by those skilled in the art that the forgoing description is a preferred embodiment of the present invention and that various changes and modifications may be made in the invention without departing from the sprit and scope thereof.

What is claimed is:

1. An internal combustion engine having a supercharger including an exhaust manifold fixed to a cylinder head and extending downwardly, an enlarged exhaust chamber of a certain capacity connected to the downstream end of the exhaust manifold, an opening formed on the exhaust chamber, a supercharger fixed to an upper side of the exhaust chamber, and a bypassing pipe connected to the opening of the exhaust chamber for communicating the exhaust chamber with an exhaust passage downstream of the supercharger bypassing the supercharger.

2. An internal combustion engine having a supercharger in accordance with the claim 1, in which the supercharger comprises a rotor having a plurality of gas passage axially extending and separated from each other, a rotor casing receiving the rotor rotatably therein, an exhaust casing disposed at one side of the rotor casing and provided with an inlet and an outlet for exhaust gas, and an intake casing disposed at the other side of the rotor and provided with an inlet and an outlet for intake gas so that the intake gas is brought into contact with the exhaust gas in the gas passages to be supercharged by the pressure of the exhaust gas as the rotor rotates, the supercharger being fixed to the upper side fo the exhaust chamber through the exhaust casing.

3. An internal combustion engine having a supercharger including an exhaust manifold fixed to a cylinder head and extending downwardly, an enlarged exhaust chamber of a certain capacity connected to the downstream end of the exhaust manifold, an opening formed on the exhaust chamber, and a bypassing pipe connected to the opening of the exhaust chamber for communicating the exhaust chamber with an exhaust passage downstream of the supercharger bypassing the supercharger, the supercharger being provided with a rotor having a plurality of gas passages axially extending and separated from each other, a rotor casing receiving the rotor rotatably therein, an exhaust casing disposed at one side of the rotor casing and provided with an inlet and an outlet for intake gas so that the intake gas is brought into contact with the exhaust gas in the gas passages to be supercharged by the pressure of the exhaust gas as the rotor rotates, the supercharger being fixed to the upper side of the exhaust chamber through the exhaust casing, the exhaust chamber being provided with a curved exhaust pipe portion extending upwardly from the lateral side thereof, and the exhaust casing of the supercharger being disposed on a top flange of the pipe portion to be fixed to the exhaust chamber through a bolt means.

4. An internal combustion engine having a supercharger in accordance with the claim 3, in which the exhaust casing of the supercharger is adapted to be fixed to the curved pipe portion of the exhaust chamber by means of first bolt means applied from the smaller curvature side of the curved pipe portion and second bolt means applied from the larger curvature side of the curved pipe portion, with the second bolt means being extended through a upper and a lower flanges formed on the curved pipe portion, and the intermediate portion of the second bolt means being exposed to the atmosphere.

5. An internal combustion engine having a supercharger in accordance with claim 3 in which the exhaust chamber is disposed in the vicinity of one end of the engine in the longitudinal direction thereof with the curved pipe portion being formed on the exhaust chamber opposite to the engine, the supercharger being disposed in such a manner that the exhaust casing, the rotor casing, and the intake casing are arranged in order from the one end side of the engine in the longitudinal direction thereof, a rotor driving means driven by an engine output being provided at the side of the intake casing, and an opening for being connected to the bypassing pipe being formed on the exhaust chamber at the other end side of the engine.

6. An internal combustion engine having a supercharger in accordance with claim 3, in which the curved pipe portion is formed on the exhaust chamber at the opposite side of the engine and an opening for being connected to a bypassing pipe of the supercharger is formed on the lateral side surface of the exhaust chamber in the longitudinal direction of the engine.

7. An internal combustion engine provided with a supercharger comprising a rotor having a plurality of gas passages axially extending and separated from each other, a rotor casing receiving the rotor rotatably therein, an exhaust casing disposed at one side of the rotor casing and provided with an inlet and an outlet for exhaust gas, and an intake casing disposed at the other side of the rotor and provided with an inlet and an outlet for intake gas so that the intake gas is brought into contact with the exhaust gas in the gas passages to be supercharged by the pressure of the exhaust gas as the rotor rotates, comprising an exhaust manifold fixed to a cylinder head of the engine at the upstream end thereof and extending downwardly, and an exhaust chamber disposed in the vicinity of one end of the engine in the longitudinal direction and connected to the downstream end of the exhaust manifold, the exhaust casing, rotor casing and intake casing being disposed in this order toward the other side of the engine in the longitudinal direction, a rotor driving means driven by engine output power being disposed in the vicinity of the intake casing, the exhaust casing being disposed over the exhaust chamber, and an exhaust passage connected with the exhaust chamber being connected with the exhaust chamber through a bypassing exhaust passage and a waste gate valve.

8. An internal combustion engine having a supercharger comprising a rotor provided with a plurality of gas passages for supercharging intake gas as the rotor rotates, in which the engine includes an exhaust manifold provided with flange portions for being fixed to the cylinder head and curved pipe portions extending downwardly, an enlarged exhaust chamber connected to the downstream side of the pipe portions, a curved pipe portion formed on the exhaust chamber at the opposite side of the exhaust manifold and extending upwardly for being connected to the supercharger, and an opening formed on a lateral surface of the chamber perpendicular to the surface on which the pipe portion of the chamber is formed, the exhaust manifold and the exhaust chamber being integrally manufactured with each other by casting to form a monoblock structure.

9. An internal combustion engine having a supercharger in accordance with claim 8, in which the exhaust chamber is disposed in the vicinity of one end of the engine in the longitudinal direction thereof, and an opening is formed for communicating a bypassing passage on a lateral surface of the exhaust chamber at the other end side of the engine in the longitudinal direction thereof.

10. An internal combustion engine in accordance with claim 8 in which the opening of the exhaust chamber is connected with an exhaust passage connected to the downstream end of the supercharger through a waste gate valve and a bypassing passage for bypassing the supercharger.

11. An internal combustion engine in accordance with claim 10 in which the bypassing passage is connected to the exhaust passage at the downstream end thereof along generally flowing line of the exhaust gas to suppress an increase of back pressure.

12. An internal combustion engine including an exhaust manifold fixed to a lateral face of a cylinder head and extending downwardly, an enlarged exhaust chamber of a certain capacity connected to the downstream end of the exhaust manifold, a supercharger fixed to an upper side of the exhaust chamber, an exhaust passage connected to the downstream end of the supercharger and extending downwardly from the supercharger, an opening provided on the enlarged exhaust chamber at the side opposite to the exhaust passage, a bypassing passage for bypassing the supercharger to communicate the opening of the enlarged exhaust chamber with the exhaust passage downstream of the supercharger through a waste gate valve.

13. An internal combustion engine in accordance with claim 12 in which the waste valve is mounted between the opening of the enlarged exhaust chamber and the bypassing passage.

14. An internal combustion engine provided with a supercharger comprising a rotor having a plurality of gas passages axially extending and separated from each other, a rotor casing receiving the rotor rotatably therein, an exhaust casing disposed at one side of the rotor casing and provided with an inlet and an outlet for exhaust gas, and an intake casing disposed at the other side of the rotor and provided with an inlet and an outlet for intake gas so that the intake gas is brought into contact with the exhaust gas in the gas passages to be supercharged by the pressure of the exhaust gas as the rotor rotates, comprising an exhaust manifold fixed to a cylinder head of the engine at the upstream end thereof and extending downwardly, and an exhaust chamber disposed in the vicinity of one end of the engine in the longitudinal direction and connected to the downstream end of the exhaust manifold, the exhaust casing, rotor casing and intake casing being disposed in this order toward the other side of the engine in the longitudinal direction, a rotor driving means driven by engine output power being disposed in the vicinity of the intake casing, the exhaust casing being disposed over the exhaust chamber, an exhaust passage connected with the exhaust chamber being connected with the exhaust chamber through a bypassing exhaust passage and a waste gate valve, the bypassing passage being connected to the exhaust passage at the downstream end thereof along generally flowing line of the exhaust gas to suppress an increase of back pressure.

15. An internal combustion engine comprising a supercharger, an exhaust manifold fixed to a cylinder head of the engine at the upstream end thereof and extending downwardly, and an exhaust chamber disposed in the vicinity of one end of the engine in the longitudinal direction and connected to the downstream end of the exhaust manifold, an exhaust passage connected with the exhaust chamber being connected with the exhaust chamber through a bypassing exhaust passage and a waste gate valve, the bypassing passage being connected to the exhaust passage at the downstream end thereof along generally flowing line of the exhaust gas to suppress an increase of back pressure.

* * * * *